United States Patent [19]

Ziegler

[11] Patent Number: 4,796,330

[45] Date of Patent: Jan. 10, 1989

[54] HINGE MASK

[76] Inventor: Frederick J. Ziegler, 205 Slitting Mill Pl., Baltimore, Md. 21228

[21] Appl. No.: 163,320

[22] Filed: Mar. 2, 1988

[51] Int. Cl.[4] ..... E05D 11/00

[52] U.S. Cl. ..... 16/251; 16/DIG. 40; 156/249

[58] Field of Search ..... 16/250, 251, DIG. 40; 156/247, 249, DIG. 2, DIG. 3

[56] References Cited

U.S. PATENT DOCUMENTS

| | | | |
|---|---|---|---|
| 3,709,763 | 1/1973 | O'Neil | 156/249 X |
| 4,570,291 | 2/1986 | Smith et al. | 16/250 |
| 4,691,409 | 9/1987 | Torgenson et al. | 16/250 |
| 4,741,793 | 5/1988 | Jones | 156/249 X |

*Primary Examiner*—Fred A. Silverberg
*Attorney, Agent, or Firm*—Walter G. Finch

[57] ABSTRACT

A hinge mask product is provided, which consists of two substantially rectangular parts, with one of the parts having a tab for removal of this one part. One part of the mask is for the face of a hinge positioned and coupled between door and a door frame. The other part of the hinge mask is for the pin of the hinge. These parts of the hinge mask are used to mask the front face of the hinge and the hinge pin to prevent them from being covered by paint, stain, lacquer, or similar material when the door and door frame are located with a material, such as paint, lacquer, and the like. Hinges are of several standard sizes, and there are several specialty sizes. The hinge mask can be manufactured to cover both standard and specialty sizes.

1 Claim, 2 Drawing Sheets

HINGE MASK

BACKGROUND AND SUMMARY OF THE INVENTION

This invention relates to painting devices, and more particularly to a hinge mask for use in painting, staining, and finishing of doors and the like.

In painting of a door which has at least two hinges provided for hanging the door to an adjacent structure, it is very difficult to paint, stain, or finish the door without getting paint, stain or finish on the hinges of the door. This is caused by the unique position of the hinges in their attachment to the door and the like.

It is an object of this invention to provide a hinge mask for the hinges of a door structure that is of superior adhesion, flexibility and application to the hinges.

Another object of this invention is to provide a hinge mask that removes cleanly and easily from door hinges.

Still another object of this invention is to provide a hinge mask which leaves no adhesive residue when removed from door hinges.

And another object of this invention is to provide hinge masks for doors and the like which withstand multiple coatings of paint as applied to the structure to which the hinges are attached.

The hinge mask product consists of two parts. One part of the mask is for the face of the hinge, and the other part is for the pin assembly of the hinge. The hinges can be of several standard sizes, and there are several specialty sizes. The hinge mask of the present invention is capable of being manufactured in any of the standard and/or specialty sizes.

Further objects and attendant advantages of the invention will become more apparent in light of the following description of the preferred embodiments of the invention.

DESCRIPTION OF THE PREFERRED EMBODIMENTS

Figure 1:
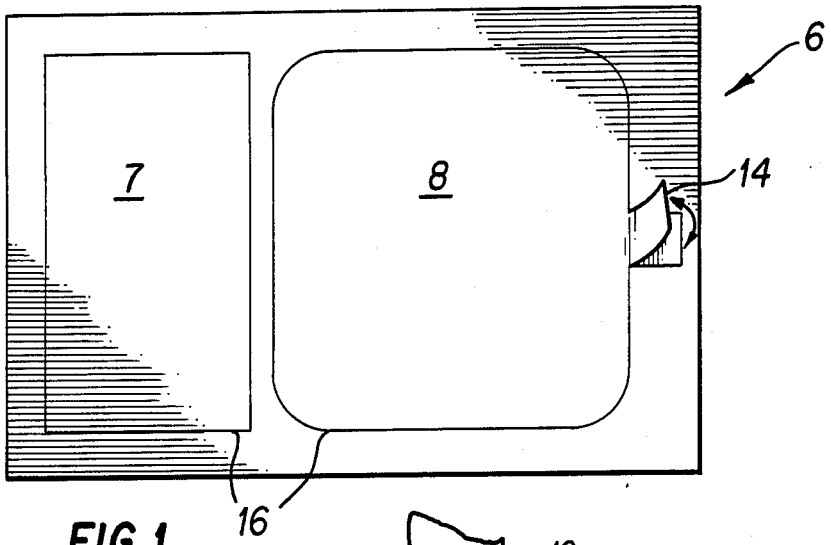
FIG. 1 is a plan view of a hinge mask product.
Figure 2:
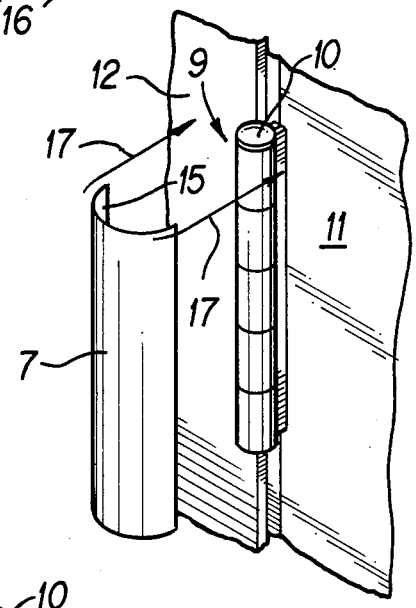
FIG. 2 is a perspective view of a hinge pin showing a part of the mask unattached to the hinge pin.
Figure 4:
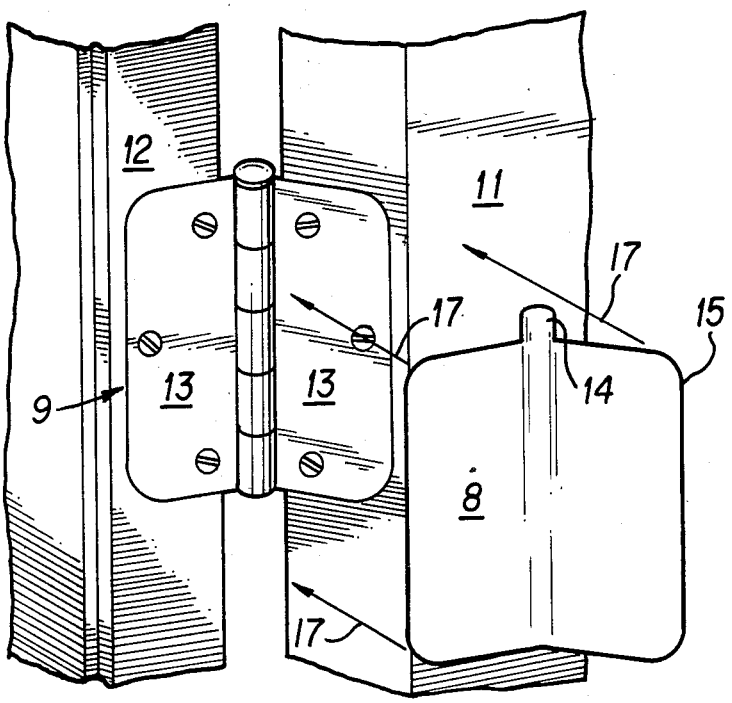
FIG. 4 is a perspective view of the front face of the hinge showing a second part of the mask unattached to the hinge.

Referring now to FIG. 1 of the invention, there is shown a hinge mask product 6 consisting of a base of material having a pin mask 7 and a hinge mask 8 for the front face of the hinge 9, shown best in FIGS. 2 and 4.

The inner faces of the pin mask 7 and hinge mask 8 have been treated with an adhesive material and positioned on the base material 6. A tab 14 is provided for hinge mask 8. Kiss-cut lines 16 encircle the pin mask 7 and the hinge mask 8, and the pin mask 7 and hinge mask 8 can be lifted from the base 6 by placing the fingernails under the parts, or by bending the base 6 to cause the hinge pin 7 and the hinge mask 8 to lift upwardly.

Figure 3:
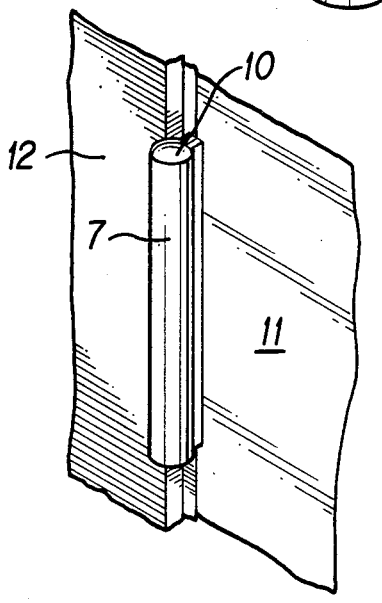
FIG. 3 is a perspective view of the hinge pin with the part of the mask of FIG. 2 attached to the hinge pin.

Referring now to FIGS. 2 and 3, there is shown a door 11 and a door frame 12 coupled together by a hinge 9 having a hinge pin 10. When the door frame 12 is to be painted, the pin mask 7 is placed over the hinge 9 as shown best in FIG. 2 and the adhesive material on the inner surface 15 of the pin mask adheres to the outer surface of the hinge pin 10. The pin mask 7 is placed on the hinge pin 10 in the direction shown by the arrows 17. FIG. 3 shows the pin mask 7 in attached position on the hinge pin 10 ready for painting, staining or finishing of the door 11 and door frame 12.

Figure 5:
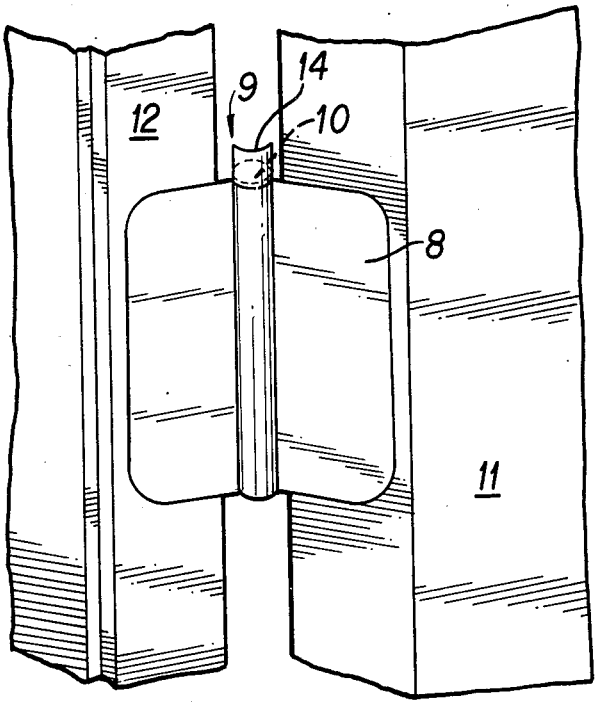
FIG. 5 is a perspective view of front face of the hinge with the second part of the mask attached to the hinge.

Referring now to FIGS. 4 and 5, there is shown the reverse side of the door 11 and door frame 12, and the hinge 9, and the hinge face 13. The hinge mask (front face) 8 is removed from the base 6, and the adhesive face of the hinge mask 8 is positioned adjacent the front face 13 of the hinge 9 in the direction of the arrows 17 to achieve the arrangement shown in FIG. 5.

Now both front and back of the door 11 and door frame can be painted, stained and/or finished without getting paint, stain or finish on the front and back of the hinge 9. The tab 14 can be used to remove the hinge mask 8. The fingers can be used to remove the pin mask 7.

As can be readily understood from the foregoing description to the invention, the present structure can be configured in different modes to provide a system for protecting surfaces, such as hinges, during painting, staining and/or finishing thereof.

Accordingly, modifications and variations to which the invention is susceptible may be practiced without departing from the scope and intent of the appended claim.

What is claimed is:

1. In an arrangement for protecting a hinge from having a material coated thereon during coating of a door and door frame, comprising, a door in said door frame wherein said hinges each comprise a pair of hinge leaves and a hinge pin, said hinges having a front face and an opposite back face, a hinge mask product comprising, a base of planar material and a hinge mask, said hinge mask consisting of two monolithic parts spacially positioned on said base, with the inner faces of said two parts being adhesive faces for being removably and adhesively attached to said base, one of said two parts being smaller in size than the other part, said one part being in the shape of a rectangle, said other part having a tab unitarily formed thereon and located on one side substantially midway between two ends, wherein said two parts are enclosed by kiss-cut lines for removing said parts from said base for attachment to the hinge, and said hinge mask adhesively positioned on the front and back faces of said hinges wherein said adhesive face of said one part being adhesively and removably attached to the back face of the entire hinge pin, said adhesive face of said other part being adhesively and removably attached to the entire front face of the hinge leaves and the hinge pin with said tab being adhesively and removably attached to the hinge pin, said tab being used to remove said other part from said hinge after the hinge has been coated.

* * * * *